US005542475A

United States Patent [19]

Turner et al.

[11] Patent Number: 5,542,475

[45] Date of Patent: Aug. 6, 1996

[54] BLANKING PLUG ASSEMBLY

[75] Inventors: Edwin C. Turner; Danny K. Wolff, both of Houston, Tex.

[73] Assignee: Cooper Cameron Corporation, Houston, Tex.

[21] Appl. No.: 348,053

[22] Filed: Dec. 1, 1994

[51] Int. Cl.[6] ..... E21B 23/06

[52] U.S. Cl. ..... 166/387; 166/115; 166/123; 166/135

[58] Field of Search ..... 166/386, 387, 166/115, 123, 135, 182, 192, 196; 277/236

[56] References Cited

U.S. PATENT DOCUMENTS

| | | | |
|---|---|---|---|
| 546,258 | 9/1895 | Suverkrop | 166/196 |
| 823,760 | 6/1906 | Callanan | 277/236 X |
| 2,753,942 | 7/1956 | Gardiner | 166/123 |
| 2,884,071 | 4/1959 | Fredd | 166/192 X |
| 3,282,346 | 11/1966 | Claycomb | 277/116.6 |
| 3,378,077 | 4/1968 | Elliston | 166/115 |
| 4,051,896 | 10/1977 | Amancharla et al. | 166/123 |
| 4,058,162 | 11/1977 | Smith | 166/135 X |
| 4,311,195 | 1/1982 | Mullins, II | 166/120 |
| 4,381,868 | 5/1983 | Croy et al. | 277/27 |
| 4,691,770 | 9/1987 | McLeod | 166/196 X |
| 4,757,860 | 7/1988 | Reimert | 166/208 |
| 4,766,956 | 8/1988 | Smith et al. | 166/182 |
| 4,823,871 | 4/1989 | McEver et al. | 166/182 |
| 4,836,278 | 6/1989 | Stone et al. | 166/115 |
| 4,984,636 | 1/1991 | Bailey et al. | 166/386 X |
| 5,094,297 | 3/1992 | Bridges | 166/382 |
| 5,110,144 | 5/1992 | Burton et al. | 277/116.2 |
| 5,129,660 | 7/1992 | Taylor et al. | 277/117 |
| 5,333,692 | 8/1994 | Baugh et al. | 166/387 |
| 5,335,729 | 8/1994 | Turner et al. | 166/380 |
| 5,355,961 | 10/1994 | Gariepy et al. | 166/387 |
| 5,390,735 | 2/1995 | Williamson | 166/115 |

FOREIGN PATENT DOCUMENTS

| | | | |
|---|---|---|---|
| 768937 | 1/1980 | U.S.S.R. | 166/196 |

OTHER PUBLICATIONS

Camco, Incorporated; *Wireline Tools and Units Catalog;* Jan. 1986; (4 p.).

Cooper Industries, Cooper Oil Tool Division; *Spooltree™ Subsea Production System;* 1993 (4 pp.).

Otis Engineering Corporation; *Wireline Subsurface Flow Controls & Related Service Equipment;* Oct. 1980; (6 pp.).

*Primary Examiner*—Hoang C. Dang

*Attorney, Agent, or Firm*—Conley, Rose & Tayon, P.C.

[57] ABSTRACT

The method and apparatus includes lowering a blanking plug assembly into the bore of an oilfield tubular member and inserting a sealing assembly on the blanking plug assembly into the seal bore of the tubular member without sealingly engaging the seal bore. A support shoulder on the blanking plug assembly lands on the landing shoulder of the oilfield tubular member. Wireline jars jar down on the lock sleeve of the blanking plug assembly to shift dog members radially outward into latching grooves in the oilfield tubular member. The lock sleeve then locks the dog members into the latching grooves. The wireline jars then jar up on a plug of the blanking plug assembly to move the plug upwardly to an upper position within the blanking plug assembly. The sealing assembly is prevented from moving upward and a tapered surface on the plug is driven through the sealing assembly thereby radially energizing the sealing assembly into sealing engagement with the outer tubular member. As the plug moves upwardly, latch members disposed on the blanking plug assembly are received by grooves in the plug to maintain the plug in its upper position. The method provides definitive indications as to whether the dog members are locked into place, whether the sealing assembly is in metal-to-metal engagement with the outer tubular member, and whether the plug is latched in its upper position.

10 Claims, 6 Drawing Sheets

BLANKING PLUG ASSEMBLY

FIELD OF THE INVENTION

This invention relates to oilfield equipment and more particularly to a method and apparatus for plugging and sealing a bore in an oilfield tubular member, and still more particularly to blanking plugs for tree caps and tubing hangers.

BACKGROUND OF THE INVENTION

Blanking plugs are utilized in the oilfield to plug and seal the flow bores of oilfield tubular members such as tree caps and tubing hangers. Oftentimes it is necessary to close the flow bore of an oilfield tubular member for flow control purposes. Typically, the oil field tubular member includes a plurality of latch grooves in its inner cylindrical wall and an inner annular landing shoulder disposed a predetermined distance below the latching grooves. The landing shoulder is typically formed by a reduced diameter portion which also serves as a seal bore for establishing a metal-to-metal seal with a sealing assembly mounted on the blanking plug.

One type of prior art blanking plug includes a locking mandrel having a tubular body with a lower threaded end for threadingly engaging a blind plug to close the bore of the locking mandrel. Above the blind plug is mounted a packing assembly which typically includes chevron seals disposed between a downwardly facing annular support shoulder on the tubular body and a lower backup ring. The chevron seals are high interference seals which sealingly engage the seal bore of the oilfield tubular member below the landing shoulder. The locking mandrel further includes a plurality of keys spring biased outwardly through windows in the wall of the tubular body. An expander sleeve is initially maintained in an upper position by shear pins which are subsequently sheared to allow the expander sleeve to move downwardly to shift and maintain the keys in their radial outward position for latching in the latching grooves of the oilfield tubular member. A fish neck is mounted on the upper end of the tubular body for lowering the blanking plug on a running tool into the bore of the oilfield tubular member.

In operation, the prior art blanking plug is run into the bore of the oilfield tubular member on the running tool and the packing assembly initiates its entry into the seal bore. Because of the high interferences of the seals, packing assembly resists entry into the seal bore. However, the high interference seals must be sufficiently inserted into the seal bore so that the support shoulder lands on the landing shoulder and thus the keys are in alignment with the latching grooves in the oilfield tubular member. To force the high interference seals into the seal bore, spang jars, located above the running tool, jar down on the blanking plug to drive the high interference seals into the seal bore. Oftentimes, it is necessary to literally beat these seals into place.

It is often difficult to determine whether the high interference seals are sufficiently disposed within the seal bore such that the blanking plug has landed on the landing shoulder. The only indication of proper landing is the metal-to-metal contact as the spang jars are pulled up and let go to jar down on the blanking plug. If the blanking plug does not land on the landing shoulder, the keys cannot expand radially outward into the latching grooves.

Using the jars to hammer the high interference seals into place, can prematurely shear a pin which holds the expander sleeve. If the pin is sheared, the keys are free to shift radially outward through the windows in the tubular body. Thus, the keys become actuated prior to aligning with the latch grooves in the oilfield tubular member even though the blanking plug has not reached the landing shoulder and is not latched into place within the oilfield tubular member. Since the high interference seals have been partially inserted into the seal bore, a pressure test on top of the blanking plug will show that the blanking plug is holding pressure and suggests that the blanking plug is locked into place when in fact it is not because the blanking plug has landed high and the keys are not aligned with the latching grooves. If the blanking plug is not locked in place, upon exposure to downhole pressure, the pressure below the blanking plug will cause the blanking plug to shoot upwardly within the bore of the oilfield tubular member.

The prior art requires jarring down to set the seals, then jarring down to set the locking keys, and then jarring down to release the running tool. There is never a positive indication that these operations have been properly completed. It is possible to jar down and obtain a partial setting of the packing assembly and then release the running tool without having the locking keys in place in the latching grooves. The pressure test from the top suggests that everything is in place. However, as soon as pressure acts on the bottom of the blanking plug assembly, the blanking plug assembly blows up the hole.

The method and apparatus of the present invention overcomes the deficiencies in the prior art.

SUMMARY OF THE INVENTION

The apparatus of the present invention includes a landing sleeve having a bore, a plurality of radially moveable dog members adapted for engagement with the latching grooves of the oilfield tubular member, and a support shoulder for engaging the landing shoulder of the oilfield tubular member. A mandrel on a plug is received within the bore of the landing sleeve and forms an annulus therewith. A lock sleeve extends into the annulus for actuating and locking the dog members into the latching grooves of the oilfield tubular member. A latch sleeve with latch members is also disposed in the annulus. The plug also includes an outer tapered portion with a sealing assembly mounted thereon in the unset position.

The method of the present invention includes lowering the blanking plug assembly into the bore of the oilfield tubular member and inserting the sealing assembly into the seal bore without sealingly engaging the seal bore. The support shoulder lands on the landing shoulder of the oilfield tubular member. Wireline jars are used to jar down on the lock sleeve to shift the dog members radially outward onto the shoulders of the latching grooves and camming the blanking plug assembly upward to lift the support shoulder off of the landing shoulder. The lock sleeve then locks the dog members into the latching grooves. The wireline jars then jar up on the plug to move the plug upwardly to an upper position within the landing sleeve. The sealing assembly is prevented from moving upward with the plug due to engagement with the lower terminal end of the landing sleeve, thus, the tapered surface of the plug is forced through the sealing assembly and the sealing assembly energizes radially outward into sealing engagement with the seal bore. As the plug moves upwardly with respect to the latch sleeve, the latch members disposed on the latch sleeve are biased radially inward and are received by grooves in the mandrel of the plug to maintain the plug in its upper position.

Jarring up on the plug provides a positive indication that the dog members are locked in place. To achieve a positive indication that the blanking plug assembly is latched and sealed, a pressure test is performed on the blanking plug assembly. No leakage is a positive indication that the blanking plug assembly is in sealing engagement with the oilfield tubular member and that the plug is latched in its upper position. Leakage is a negative indication that either the sealing assembly has not established a seal with the seal bore or that the plug is not properly latched within the latch sleeve.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 9:
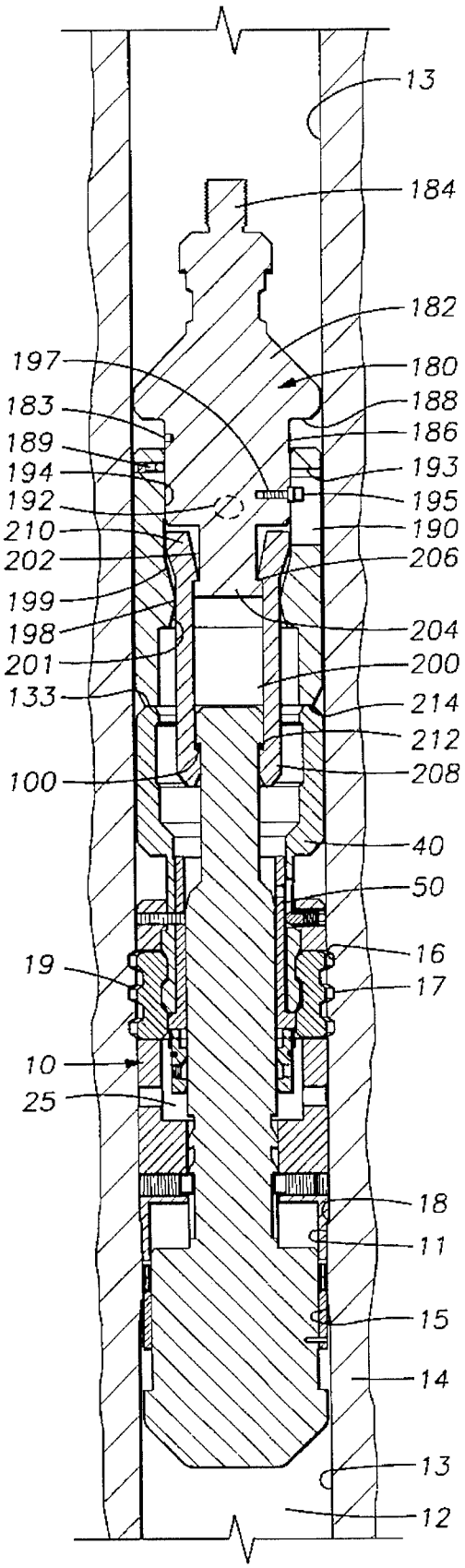
FIG. 9 is a cross-sectional view of the running tool having lowered the blanking plug assembly of FIG. 1 into the bore of an oilfield tubular member and with the blanking plug assembly having landed on the landing shoulder of the oilfield tubular member.

Referring initially to FIG. 9, the blanking plug assembly 10 of the present invention is utilized to plug and seal the flow bore 12 in an oilfield tubular member 14 such as a tubing hanger or a tree cap. A tree cap, for example, may used in the upper part of a horizontal tree. The oilfield member 14 includes a plurality of latching grooves 16 and an upwardly facing, inwardly and downwardly tapering frusto-conical shoulder 18 serving as a landing shoulder. Latching grooves 16 include upwardly facing, inwardly and downwardly tapering frusto-conical shoulders 17 and downwardly facing, inwardly and upwardly tapering frusto-conical shoulders 19. Typically there are three latching grooves 16. Landing shoulder 18 is located a predetermined distance below latching grooves 16. Landing shoulder 18 is often referred to as a no-go shoulder. Landing shoulder 18 is formed by a reduced diameter cylindrical seal bore 11 extending radially inward of cylindrical wall 13. Reduced diameter seal bore 11 includes a downwardly facing outwardly tapering frusto-conical relief 15. Landing shoulder 18 and relief 15 are formed by the transitions between cylindrical wall 13 and seal bore 11. Blanking plug assembly 10 is landed on landing shoulder 18 and is latched into place at latching grooves 16, as hereinafter described in further detail.

Figure 1:
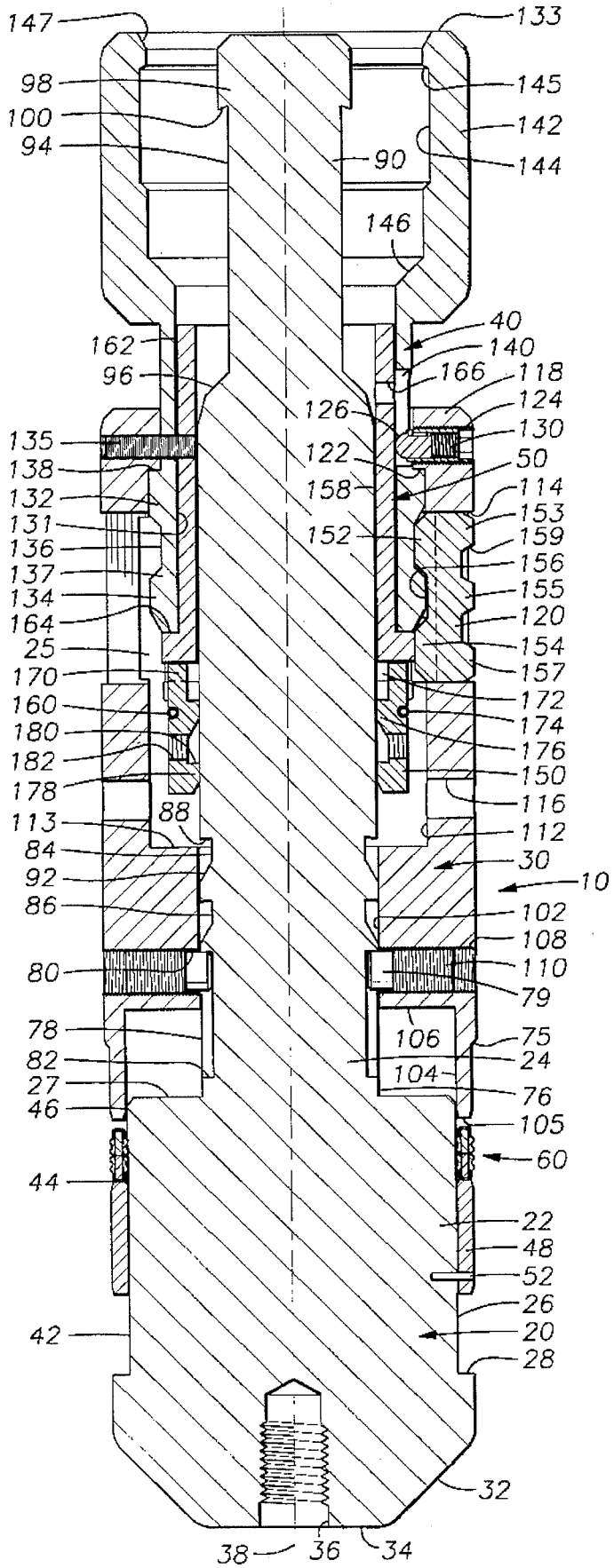
FIG. 1 is a cross-sectional view of the blanking plug assembly of the present invention with one locking dog removed for clarity.
Figure 2:
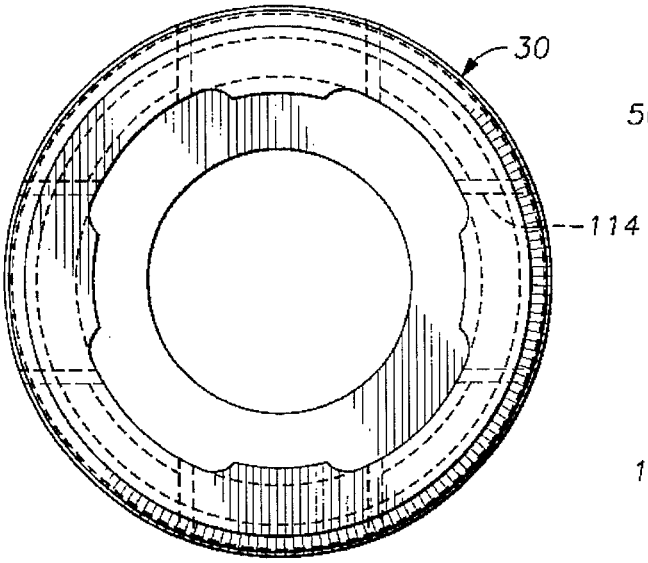
FIG. 2 is a top view of the landing sleeve of the blanking plug assembly of FIG. 1.
Figure 6:
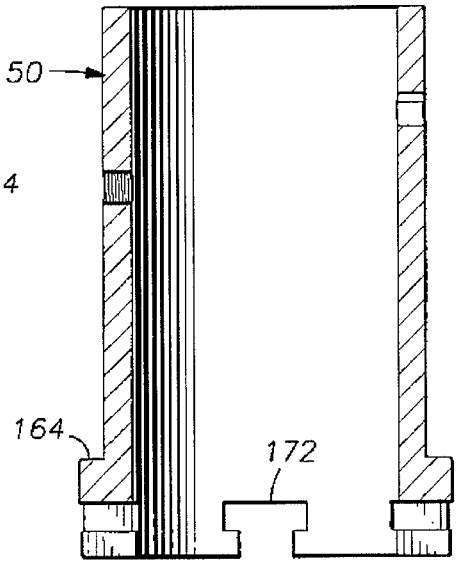
FIG. 6 is a cross-sectional view of the latch sleeve of the blanking plug assembly of FIG. 1.
Figure 3:
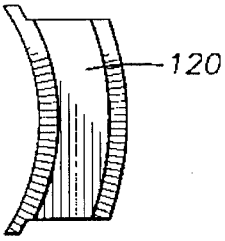
FIG. 3 is a top view of the dog member mounted on the landing sleeve of FIG. 2.
Figure 4:
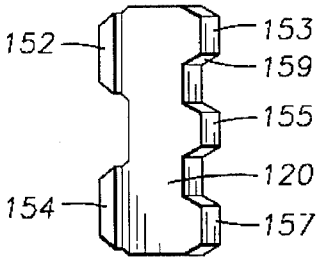
FIG. 4 is a side elevation view of the dog member of FIG. 3.
Figure 7:
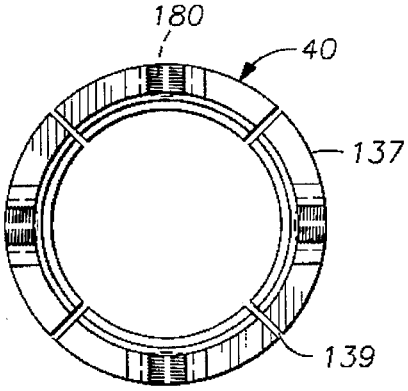
FIG. 7 is a top view of the latch members mounted on the latch sleeve of FIG. 6.

Referring now to FIG. 1, the blanking plug assembly 10 of the present invention includes a plug 20, a landing sleeve 30, a lock sleeve 40, and a latch sleeve 50. Plug 20 includes a head 22 with an upwardly projecting mandrel 24 thereby forming an upwardly facing annular shoulder 27. Landing sleeve 30 receives mandrel 24 with lock sleeve 40 and latch sleeve 50 also receiving mandrel 24 and having a portion thereof disposed in the annulus 25 formed between mandrel 24 and landing sleeve 30.

The head 22 of plug 20 includes a reduced diameter portion 26 forming an upwardly facing annular shoulder 28. The lower end of head 22 is conical in shape forming a nose 32. The lower terminal end 34 of plug 20 includes a tapped bore 36 used for handling and assembly. Bore 36 is centered on the center line or axis 38 of blanking plug assembly 10.

Reduced diameter portion 26 includes a lower cylindrical portion 42, a roedial conically tapered portion 44 and an upper cylindrical portion 46. The medial conically tapered portion 44 has a predetermined inward and upward taper, such as 2 degrees, forming a frusto-conical surface whereby cylindrical portion 42 is a larger diameter than cylindrical portion 46. A seal support ring 48 is received over reduced diameter portion 26 and pinned to lower cylindrical portion 42 by shear pins 52. Seal support ring 48 is located on head 22 to support a sealing assembly 60 initially disposed around medial conically tapered portion 44. Shear pins 52 hold seal support ring 48 and seal assembly 60 in an upper, unset position as the blanking plug assembly 10 is lowered into the bore 12. Seal support ring 48 protects the sealing assembly 60 as it is lowered through bore 12 and also prevents it from prematurely being actuated into sealing engagement. Also, if it becomes necessary to pull the blanking plug assembly 10 out of bore 12, the seal support ring 48 ensures that the sealing assembly 60 will not hang up and seal on something as it is pulled out of the hole. Seal support ring 48 is preferred but optional.

Figure 9A:
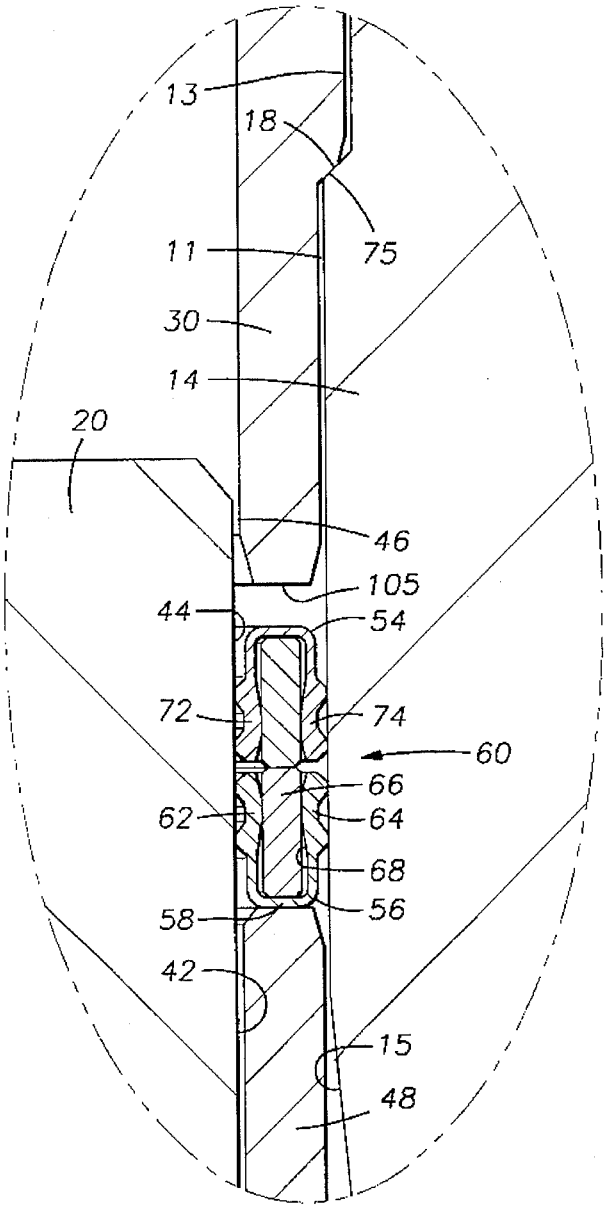
FIG. 9A is an enlarged detailed view of the metal-to-metal sealing assembly mounted on the blanking plug assembly as shown in FIG. 9 and in the unsealed position.

Referring now to FIG. 9A, sealing assembly 60 is shown enlarged and in the unset position. Sealing assembly 60 is described in detail in U.S. patent application Ser. No. 08/052,777, filed Apr. 26, 1993 entitled *Annular Sealing Assembly*, incorporated herein by reference. Sealing assembly 60 includes an upper sealing ring assembly 54 and a lower sealing ring assembly 56 made of metal and preferably stainless steel. Each sealing ring assembly 54, 56 includes a U-shaped ring having a base 58 and a pair of legs 72, 74 and 62, 64, respectively. A plurality of segments 66 are disposed within the annular recess 68 formed by legs 72, 74 and 62, 64. The inner legs 62, 72 of sealing ring assemblies 56, 54, respectively, are at an angle with respect to the axis 38. Angled legs 62, 72 are adjacent the medial conically tapered portion 44 of reduced diameter portion 26. Sealing ring assemblies 54, 56 establish a metal-to-metal seal with seal bore 11. Outer legs 64, 74 of sealing ring assemblies 56, 54, respectively, are generally parallel to the axis 38. The two sealing ring assemblies 54, 56 face each other in order to reduce sealing stroke or travel and thus minimize the length of blanking plug assembly 10.

The seal assembly 60 has a 0.010 diameter clearance with the cylindrical wall 13 of tubular member 14. Thus, the sealing assembly 60 of the present invention can not serve as an impediment to the blanking plug assembly 10 landing on landing shoulder 18 as does the prior art. With the sealing assembly 60 having a ten thousandths clearance with the cylindrical wall 13, the operator is assured that the sealing assembly 60 will not cause a premature indication of landing the blanking plug assembly 10 on landing shoulder 18. Landing on shoulder 18 is crucial to ensure that there is alignment with latching grooves 16.

Referring now to FIGS. 1 to 8, the upwardly extending mandrel 24 includes an outer cylindrical surface 76 having a plurality of elongated slots 78 extending axially. Slots 78 form upper and lower shoulders 80, 82. A pair of upper and lower latch grooves 84, 86 are disposed circumferentially around mandrel 24 above each of slots 78. Each of the latch grooves 84, 86 includes a downwardly facing annular shoulder 88 and an upwardly facing, downwardly and outwardly tapering annular surface 92.

An OD fish neck 90 is disposed on the upper end of mandrel 24 and has a profile on its outer diameter. OD fish neck 90 includes a reduced diameter portion 94 forming an upwardly facing tapered annular shoulder 96. OD fish neck 90 further includes an enlarged head 98 forming a downwardly facing annular hook shoulder surface 100.

Landing sleeve 30 includes a central bore 102 for slidingly receiving the outer cylindrical wall 76 of mandrel 24. Landing sleeve 30 also includes a lower counterbore 104 forming a downwardly facing annular stop shoulder 106. Counterbore 104 is sized to receive the reduced diameter portion 26 of plug 20. A downwardly facing annular support shoulder 75 is disposed around the exterior of the cylindrical wall forming lower counterbore 104. Annular support shoulder 75 is dimensioned for supporting engagement with landing shoulder 18 of member 14. A plurality of threaded bores 108 extend transversely to the axis 38 through the wall of landing sleeve 30 for threadingly receiving pins 110 which extend into the aligned slots 78 in mandrel 24. Pins 110 are made of a high strength steel and have an inner portion 79 which reciprocates axially within slots 78. Pins 110 hold landing sleeve 30 and plug 20 together while allowing plug 20 to reciprocate with respect to landing sleeve 30. Pins 110 ride within slots 78 and will engage shoulders 80, 82 to limit the relative axial movement between plug 20 and landing sleeve 30.

Referring now particularly to FIGS. 1 and 2–4, landing sleeve 30 further includes an enlarged diameter upper inner bore 112 forming an upwardly facing travel stop 113 and includes a plurality of windows 114 preferably four. An arcuate dog 120 is disposed within each of the windows 114 for radial movement. A plurality of access bores 116 extend traversely of the axis 38 through the wall of landing sleeve 30 for unlatching the latch sleeve 50 as hereinafter described in further detail. The upper end of landing sleeve 30 includes a plurality of inwardly directed arcuate flanges 118 forming downwardly facing arcuate shoulders 122. A threaded bore 124 passes radially through one of the arcuate flanges 118. A spring detent 130 is threaded in threaded bore 124 and includes a housing with a spring biasing radially inward and a detent member 126.

Figure 5:
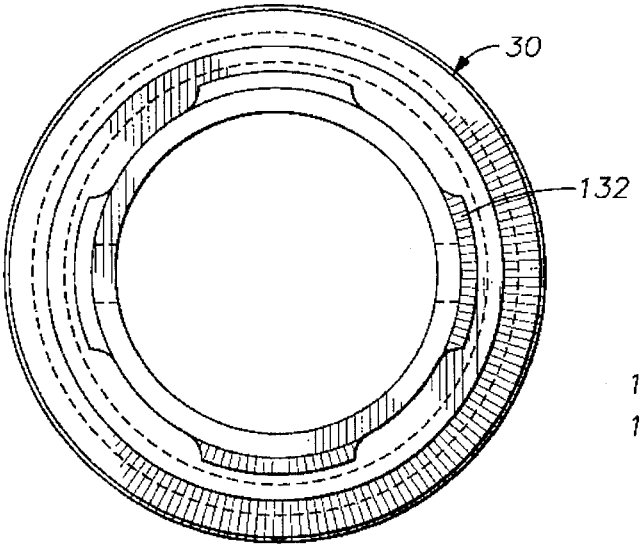
FIG. 5 is a bottom view of the lock sleeve of the blanking plug assembly of FIG. 1.
Figure 8:
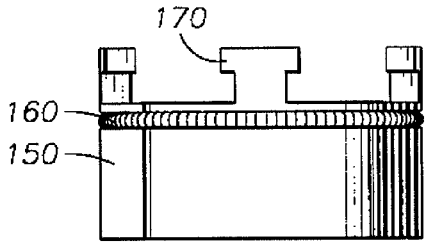
FIG. 8 is a partial side elevation view of a latch member of FIG. 7.

Referring now particularly to FIGS. 1 and 5, lock sleeve 40 includes a downwardly extending cylindrical portion forming an inner bore 131 and four downwardly extending keys 137 having slots 139 therebetween for receiving dogs 120 during assembly. Each key 137 has a pair of outwardly projecting upper and lower arcuate shoulders 132, 134 forming an arcuate groove 136 therebetween. Upper annular shoulder 132 includes an upwardly facing arcuate shoulder 138 for abutting engagement with downwardly facing arcuate shoulder 122 on flange 118 of landing sleeve 30. Lock sleeve 40 further includes an axial slot 140 through which projects spring detent 130 allowing detent 130 to reciprocate therewithin The projection of spring detent 130 into slot 140 prevents lock sleeve 40 from rotating with respect to landing sleeve 30 after assembly.

An ID fish neck 142 is disposed at the upper end of lock sleeve 40 and has a profile on its inner diameter. ID fish neck 142 includes an enlarged inner diameter portion 144 and an upwardly facing, downwardly tapering annular shoulder 146. Enlarged portion 144 forms a downwardly facing annular shoulder 145 for engagement with a pulling tool 220, as hereinafter described. The upper terminal end 133 of ID fish neck 142 is used as a jarring surface, as hereinafter described.

Dogs 120 include a pair of inwardly directed arcuate shoulders 152, 154 forming a groove 156 therebetween. Upon assembly as hereinafter described, the lower cylindrical portion of lock sleeve 40 is received within annulus 25 and enlarged diameter portion 112 of landing sleeve 30 such that lower arcuate shoulder 134 is received within groove 156 of dogs 120. Likewise, the upper arcuate shoulder 152 of dogs 120 is received within groove 136 of lock sleeve 40.

Dogs 120 also include three outwardly directed arcuate shoulders 153, 155, and 157 dimensioned to be received within the three latch grooves 16 on oilfield tubular member 14. Each of the three outer arcuate shoulders include a downwardly facing and upwardly tapering cam surface 159 adapted for camming engagement with the upwardly facing and downwardly tapering annular shoulders 17 of latching grooves 16. The spacing or distance between annular support shoulder 75 and cam surfaces 159 is set at a predetermined distance which is shorter than the spacing or distance between landing shoulder 18 and annular shoulders 17 on outer tubular member 14. As hereinafter described in further detail, upon the actuation of dogs 120, cam surfaces 159 cam upward onto tapered annular shoulders 17 causing the blanking plug assembly 10 to lift off of landing shoulder 18 the difference of the predetermined distances 77 (See FIG. 10A). This predetermined difference 77 is preferably 0.020 inches.

Referring now particularly to FIGS. 1 and 6–8, latch sleeve 50 includes an inner bore 158 for slidingly receiving mandrel 24 and projects into annulus 25 between mandrel 24 and landing sleeve 30. Latch sleeve 50 also includes a reduced diameter outer cylindrical portion 162 which is slidingly received within the inner bore 131 formed by lock sleeve 40. The reduced diameter 162 forms an upwardly facing annular shoulder 164 which engages the lower terminal end of the keys 137 on lock sleeve 40. Further, latch sleeve 50 includes a detent cavity or aperture 166, which when aligned with spring detent 130, will receive detent member 126 (See FIG. 10).

On the lower end of latch sleeve 50 is mounted a plurality of latch segments 150 movable radially. Latch segments 150 include a T-head 170 received in a T-slot 172 adjacent the lower terminal end of latch sleeve 50. Latch segments 150 include an outwardly facing arcuate groove 174 in which is disposed a ting-like spring 160. Latch segments 150 further include a pair of inwardly directed arcuate latch shoulders 176, 178 dimensioned to be received within annular latch grooves 84, 86 in mandrel 24. Latch shoulders 176, 178 each include upwardly facing arcuate shoulders 180 adapted for engagement with downwardly facing annular shoulders 88 on mandrel 24. Latch segments 150 further include a threaded bore 182 adapted for threaded engagement with a release bolt (not shown) to be inserted through access bores 116 of landing sleeve 30 for the disengagement of latch segments 150 during disassembly. Although a collet connection could be used in place of latch segments 150, a collet connection would add length to the blanking plug assembly 10.

A shear pin 135 extends through landing sleeve 30, lock sleeve 40 and latch sleeve 50. Shear pin 135 may be termed a two stage shear pin. Shear pin 135 initially maintains lock sleeve 40 and latch sleeve 50 in an upper position such that key 137 allows dogs 120 to be in the radially inward and unset position. Shear pin 135 is sheared at the interface between landing sleeve 30 and lock sleeve 40 upon jarring down on the upper end 133 of lock sleeve 40 since the point of shear is located at that interface. Upon shearing pin 135 at this interface, lock sleeve 40 and latch sleeve 50 move to their downward or lower position. Upon latch segments 150 having engaged latch grooves 84, 86 in mandrel 24, blanking plug assembly 10 may be retrieved using a pulling tool 220, hereinafter described, which engages ID neck 142 to jar upward against the latching engagement of latch segments 150 and latch grooves 84, 86. The jarring up causes shear pin 135 to shear at the interface between lock sleeve 40 and latch sleeve 50. The upward movement of lock sleeve 40 unsets dogs 120 and allows them to shift back into their radial inward and unset position. Thus, shear pin 135 serves multiple purposes, first to maintain lock sleeve 40 and latch sleeve 50 in the upper position, second, to cause both lock sleeve 40 and latch sleeve 50 to move to their lower position together, and third, to allow lock sleeve 40 to move upwardly with respect to latch sleeve 50 after latch sleeve 50 has been latched with mandrel 24.

Referring again to FIG. 1, in the assembly of blanking plug assembly 10, seal retainer ring 48 is pinned on reduced diameter portion 26 and sealing assembly 60 is received over the medial conically tapered portion 44 of reduced diameter portion 26 of plug 20. Mandrel 24 (with dogs 120 installed) is then inserted into bore 102 of landing sleeve 30 thereby forming annulus 25. The head 22 of plug 20 is received within counterbore 104 of landing sleeve 30 and slots 78 are aligned with bores 108. Pins 110 are then threaded through threaded bore 108 such that the inner end 79 of pins 110 are received within slots 78. Latch sleeve 50 (with latch segment 150 attached) is then received over mandrel 24. Lock sleeve 40 is inserted into annulus 25 between landing sleeve 30 and latch sleeve 50 with slots 139 being aligned with dogs 120. Upon lock sleeve 40 engaging upwardly facing shoulder 164 on latch sleeve 50, lock sleeve 40 is rotated whereby keys 137 are aligned behind dogs 120 and landing sleeve 30, lock sleeve 40, and latch sleeve 50 are aligned to receive shear pin 135.

Figure 12:
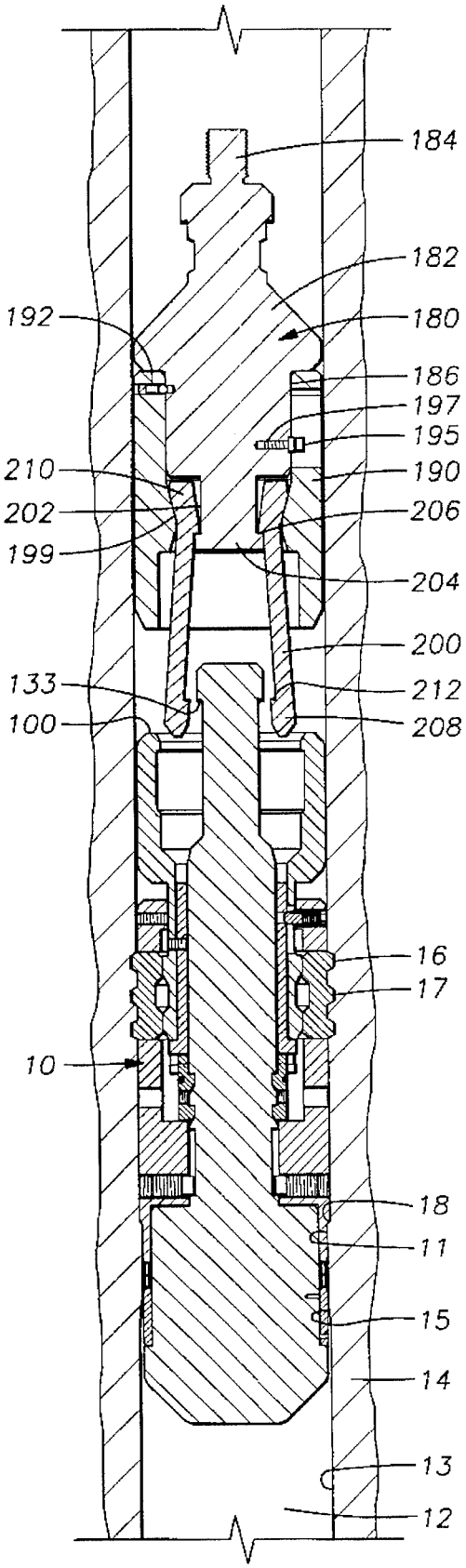
FIG. 12 is a cross-sectional view of the running tool and blanking plug assembly of FIG. 1 with the running tool in the disengaged position.

Referring again to FIG. 9, the blanking plug assembly 10 is inserted into the bore 12 of tubular member 14 by a running tool 180. Running tool 180 includes a generally cylindrical body 182 having a sucker rod connection 184 at its upper end for connection to equipment extending to the surface. Body 182 includes a lower cylindrical reduced diameter portion 186 forming a downwardly facing annular shoulder 188. An actuation sleeve 190 is slidingly disposed on cylindrical portion 186 and is held in position on cylindrical portion 186 by shear pins 192. Actuation sleeve 190 also includes a threaded transverse bore receiving a spring detent 189 which projects into detent here 183 when the sleeve 190 is in its upper position as shown in FIG. 12. Sleeve 190 also includes slots 193 for threading pins 195 into threaded bores 197 in body 182 for attaching sleeve 190 to body 182 in an axially movable manner. Actuation sleeve 190 includes a generally cylindrical bore 194 for receiving cylindrical portion 186 of running tool 180. The lower end of bore 194 includes a reduced diameter annular pivot shoulder 198 forming an upper tapered surface 199 and a lower tapered surface 201. The lower end of body 182 includes a further reduced diameter portion 202 having a head 204 forming an upwardly facing annular shoulder 206. A plurality of downwardly extending latch fingers 200 are mounted on body 182. Fingers 200 include enlarged angled heads 210 which abut annular shoulder 206 and are captured between actuation sleeve 190 and further reduced diameter portion 202. The lower ends 208 of fingers 200 include an upwardly facing hook shoulder 212 adapted for engagement with the downwardly facing hook shoulder 100 on OD fish neck 90. Fingers 200 pivot on annular pivot shoulder 198 depending on the relative position of actuation sleeve 190 on cylindrical portion 186 of body 182.

In FIG. 9, running tool 180 is shown in the engaged position with blanking plug assembly 10. Actuation sleeve 190 is in its lowermost position such that annular pivot shoulder 198 is below head 204 thereby forcing the lower ends 208 of fingers 200 in their radial inward position. In this position, hook shoulders 212 are opposite annular hook shoulder 100 so as to engage and thus support blanking plug assembly 10 on running tool 180 as it is lowered into bore 12.

Although not shown in the figures, spang jars or wireline jars are disposed above running tool 180 for jarring up or down on blanking plug assembly 10. The lower terminal end 214 of actuation sleeve 190 abuts the upper terminal end 133 of lock sleeve 40. Thus, the spang jars place a driving force on blanking plug assembly 10 through the running tool 180. A typical wireline or spang jar is manufactured by Camco, Inc. of Houston, Tex. and is disclosed and described on pages 10 and 11 of Camco's brochure dated January 1986 and entitled *Wireline Tools and Units Catalog*, incorporated herein by reference. Other manufacturers of wire line jars include Otis, Baker, and Bowen. A spang jar provides a fixed amount of upward or downward jarring movement of the wire line tool string. There are three types of jars namely link, tubular, and hydraulic jars. Link and tubular jars are mechanical jars which accommodate both upward and downward jarring. These jars deliver a jarring impact through the entire length of the tool string. Hydraulic jars, for upward jarring only, are used to apply a high-impact force. By way of example, link jars consist of interlocking steel links which can be extended or collapsed by manipulating the wire line at the surface to produce an upward or downward jarring impact. The intensity of the jarring impact depends on the weight of the wire line stem installed immediately above the jar, the stroke length of the jar, and the density of the well fluid.

To release running tool 180, spang jars jar down with sufficient force to shear pins 192 causing body 182 to move downwardly with respect to actuation sleeve 190. This movement aligns spring detent 189 with detent hole 183 thereby connecting body 182 and sleeve 190. As best shown in FIG. 12, as actuation sleeve 190 moved upwardly with respect to body 182 on reduced diameter portion 186, annular tapered surface 199 engages the angled backside of heads 210 of fingers 200. This engagement causes the lower heads 208 of fingers 200 to move radially outward thereby disengaging hook shoulders 212 from hook shoulder 100. Upon disengagement, running tool 180 may be retrieved from the bore 12.

Figure 13:
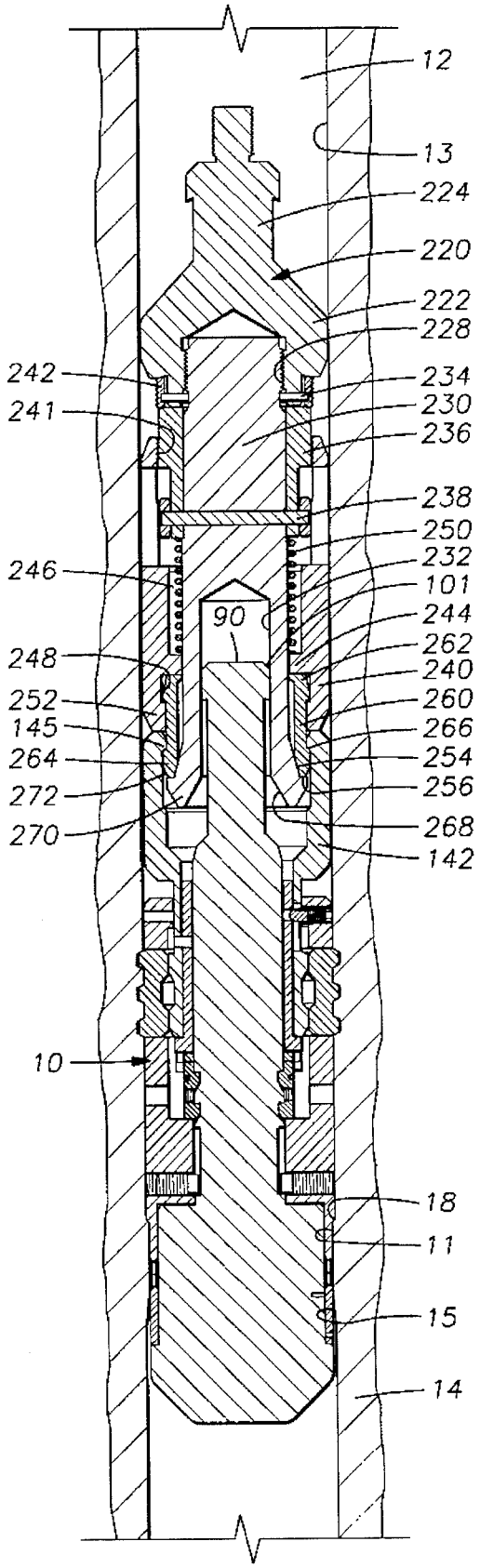
FIG. 13 is a cross-sectional view of a pulling tool connected to the blanking plug assembly of FIG. 1 for retrieving the blanking plug assembly from the bore of the oilfield tubular member.

Referring now to FIG. 13, there is shown the pulling tool 220. Pulling tool 220 includes an upper connector 222 having a fish neck 224 at its upper end and a sucker rod connection 226. Connector 222 includes a lower threaded bore 228 for threaded engagement with the upper end of a mandrel 230 which projects downwardly from connector 222. Mandrel 230 includes a blind bore 232 adapted for receiving OD fish neck 90 of mandrel 24 of blanking plug assembly 10. A set screw 234 prevents the premature unthreading of the connection between mandrel 230 and connector 222. A retainer sleeve 236 is received over mandrel 230 and is pinned to mandrel 230 by a long shear pin 238. A plurality of serrated segments 242 are disposed between the upper end of retainer sleeve 236 and a downwardly facing annular shoulder on connector 222. An actuator sleeve 240 is also disposed around mandrel 230 and includes a serrated inwardly directed annular shoulder 241 at its upper end. Sleeve 240 also includes a inwardly directed annular flange 244 which forms an annular space 246 that houses a compression spring 250 that is compressed between the lower terminal end of retainer sleeve 236 and the upwardly facing shoulder of annular flange 244. The lower end of actuator sleeve 240 includes an enlarged bore 248 with an inwardly directed reduced diameter 252. The lower end of mandrel 230 is flared forming an outer tapered surface 254 and an upwardly facing annular shoulder 256. The lower end also forms an inner tapered surface 268. A plurality of collapsing fingers 260 are disposed between actuator sleeve 240 and mandrel 230 adjacent their lower ends. Collapsing fingers 260 include an angled upper head 262 and a lower head 264 having an upwardly facing annular shoulder 266 adapted for engagement with annular flange 145 on ID fish neck 142.

Referring now to FIGS. 1 and 13, in operation, pulling tool 220 is lowered into bore 12 of tubing member 14. The upper terminal end of OD fish neck 90 includes a chamfered annular surface 101 which initially engages the inner tapered surface 268 of mandrel 230. This engagement aligns the pulling tool 220 with the blanking plug assembly 10. The nose 270 on the lower terminal end of mandrel 230 is sized to barely clear the inside diameter of OD fish neck 142. The lower head 264 of collapsing fingers 260 includes an outer tapered surface 272 adapted to engage the inner tapered surface 147 of ID fish neck 142. These tapers initially engage as the pulling tool 220 is lowered into bore 12 forcing collapsing fingers 260 and actuation sleeve 240 to move upward on mandrel 230 thereby compressing compression spring 250. Upon the further downward movement of pulling tool 220, the fingers 260 collapse against the cylindrical outer wall of mandrel 230 above flared surface 254. Once the lower head 264 clears the internal diameter of ID fish neck 142, fingers 260 are free to expand as spring 250 pushes downward on actuation sleeve 240. Upon pulling back up on pulling tool 220, spring 250 forces actuation sleeve 240 to remain in contact with the upper terminal end 133 of lock sleeve 40 such that tapered surface 254 cams fingers 260 outward into engagement with the downwardly facing annular shoulder 145 on ID fish neck 142. With latch segments 150 engaged in latch grooves 84, 86, pulling tool 220 then places an upward force on lock sleeve 40 causing shear pin 135 to shear at the interface between lock sleeve 40 and latch sleeve 50. The upward movement of lock sleeve 40 will release dogs 120 without releasing latch segments 150 in latch grooves 84, 86.

An alternative embodiment of the blanking plug assembly 10 includes a small bore extending axially through the entire length of plug 20. A break off plug is mounted within the bore. The break off plug could be in the form of a sting open check valve, a back pressure valve or a rupture disk. If there is any pressure build up under the blanking plug assembly 10, the plug is broken prior to pulling the blanking plug assembly 10 out of the bore 12 and the pressure allowed to bleed off. If pressure has built up under the blanking plug assembly 10, upon releasing it with the pulling tool 220, it could blow out of the tubular member 14.

For the methods of the present invention and the operation of the apparatus of the present invention, reference will now be made to FIGS. 9–13 as well as the details shown in FIGS. 9A, 10A, and 11A. The method of plugging the bore 12 of tubular member 14 comprises the steps of inserting blanking plug assembly 10 into the bore 12 of tubular member 14. The sealing assembly 60 passes into the seal bore 11 on tubular member 14 without establishing a seal. The blanking plug assembly 10 is landed on landing shoulder 18 of tubular member 14. The wireline jars then jar down on landing sleeve 30 to shift dogs 120 radially outward toward latching grooves 16. The tapered shoulders 159 on dogs 120 cam with tapered shoulders 17 of latching grooves 16 thereby raising the blanking plug assembly 10 off of landing shoulder 18. Dogs 120 then move radially outward and are locked into position within latching grooves 16 by lock sleeve 40. The wireline jars then jar up on mandrel 24 of plug 20 causing plug 20 to move upwardly. As plug 20 moves upwardly, sealing assembly 60 engages the lower terminal end of landing sleeve 30. The continuing upward movement of plug 20 shears pins 52 and plug 20 drives the medial conically tapered portion 44 through the internal diameter of sealing assembly 60 causing sealing assembly 60 to sealingly engage the seal bore 11 of tubular member 14. Upon plug 20 reaching its upper position, latch grooves 84, 86 are aligned with latch segments 150 and spring 160 shifts latch segments 1.50 radially inward and into latch grooves 84, 86. A further detailed description of the method of the present invention and the operation of the apparatus of the present invention follows.

Referring now to FIG. 9, running tool 180 is connected to blanking plug assembly 10 by raising actuation sleeve 190 causing fingers 200 to move radially outward and inserting OD fish neck 90 between fingers 200. Actuation sleeve 190 is lowered and shear pins 183 are set whereby hook shoulders 212 engage annular hook shoulder 100. The blanking plug assembly 10 is then inserted into bore 12 of tubular member 14 by running tool 180.

Referring now to FIG. 9A, the sealing assembly 60, being mounted on plug 20 below support shoulder 75, enters seal bore t 1 prior to support shoulder 75 engaging landing shoulder 18. The sealing assembly 60 mounted on reduced diameter 26 has an outer diameter which is smaller than the inner diameter of seal bore 11. This predetermined diametric clearance is preferably 0.010 inches. Thus, sealing assembly 60 clears the cylindrical wall of seal bore 11 by five thousandths of an inch. As previously described, sealing assembly 60 is mounted on plug 20 adjacent tapered portion 44 which has a smaller diameter than lower cylindrical portion 42. Sealing assembly 60 is supported in this unset position by seal support ring 48. After insertion of the sealing assembly 60 in seal bore 11, support shoulder 75 engages and lands on landing shoulder 18. In this position, the sealing assembly 60 is unset and no seal has been established between blanking plug assembly 10 and tubular member 14.

Figure 10:
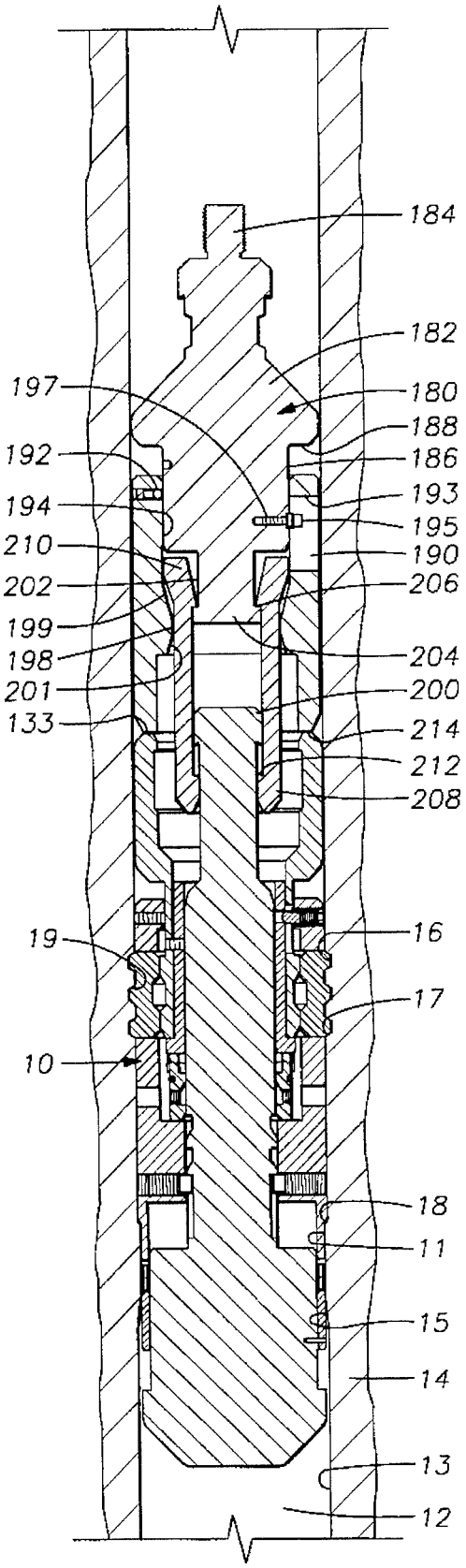
FIG. 10 is a cross-sectional view of the blanking plug assembly of FIG. 1 in the lock set position with the blanking plug assembly lifted off of the landing shoulder of the oilfield tubular member.

Referring now to FIG. 10, the spang jars then jar downwardly on running tool 180. This jarring movement is transmitted Through actuation sleeve 190 to lock sleeve 40. The jarring down on lock sleeve 40 shears shear pins 135 at the interface between landing sleeve 30 and lock sleeve 40 allowing lock sleeve 40 and latch sleeve 50 to move downwardly together within annulus 25. Lock sleeve 40 remains pinned by shear pins 135 to latch sleeve 50 and, upon jarring down, lock sleeve 40 and latch, sleeve 50 move as a unit and engage travel shoulder 113. With lock sleeve 40 and latch sleeve 50 in their lower position, detent member 126 becomes aligned with detent aperture 166 and expands inwardly into detent aperture 166. Detent member 126 maintains latch sleeve 50 in its lower position within landing sleeve 30.

As lock sleeve 40 moves downwardly, the lower frustoconical surfaces of shoulders 132, 134 cammingly engage the upwardly facing tapered surfaces of arcuate shoulders 152, 154 of dogs 120. This camming engagement shifts dogs 120 radially outward. Latching grooves 16 are a predetermined distance higher than dogs 120 above landing shoulder 18 such that tapered surfaces 159 on dogs 120 engage tapered annular shoulders 17 of latching grooves 16. This camming engagement upon the radial shift of dogs 120 raises blanking plug assembly 10 off of landing shoulder 18. Upon completion of the downward movement of lock sleeve 40 into annulus 25, annular shoulders 132, 134 of lock sleeve 40 are aligned behind and abut arcuate shoulders 152, 154 of dogs 120 thereby locking dogs 120 in latching grooves 16.

Figure 10A:
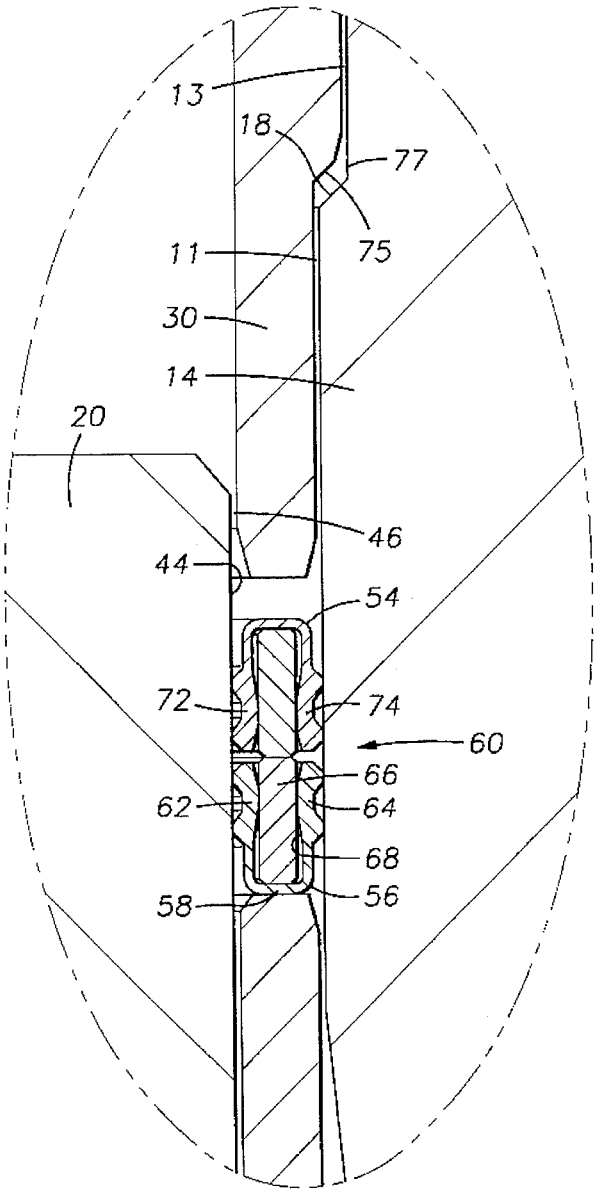
FIG. 10A is an enlarged detail of the blanking plug assembly as shown in FIG. 10 having been lifted off of the landing shoulder of the oilfield tubular member.

Referring now to FIG. 10A, support shoulder 75 is shown lifted off of landing shoulder 18 a predetermined distance 77, preferably 0,020 inches. The load of blanking plug assembly 10 is removed from landing shoulder 18 because landing shoulder 18 does not have adequate bearing area to support the required bearing load. For example, a bearing load greater than that imposed by 15,000 psi would cause landing shoulder 18 to fail in bearing. In the present invention, the bearing load is supported by shoulders 17 of latching grooves 16. Since there are three bearing shoulders 17, substantial more bearing area is provided to support the beating load. It should also be appreciated that there is a load being placed on the downwardly facing annular shoulders 19 of latching grooves 16. Thus, the beating engagement between dogs 120 and the shoulders 17, 19 of latching grooves 16 has adequate beating area to withstand the anticipated loads from either above or below the blanking plug assembly 10.

Figure 11:
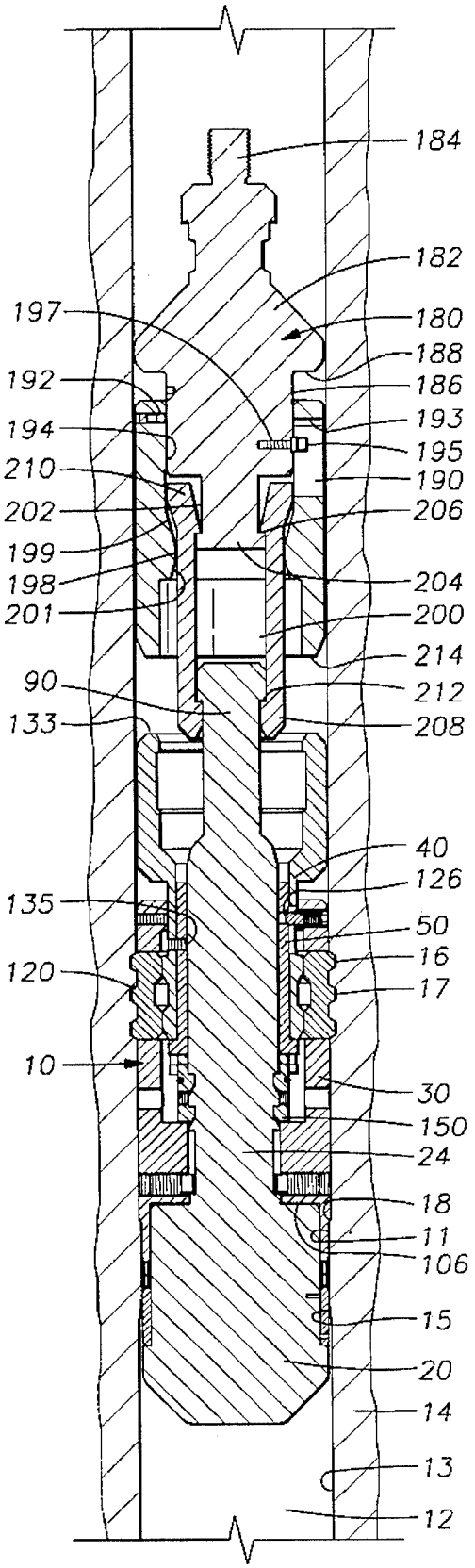
FIG. 11 is a cross-sectional view of the blanking plug assembly of FIG. 1 with the metal-to-metal sealing assembly in sealing engagement with the oilfield tubular member.

Referring now to FIG. 11, once dogs 120 have been shifted radially outward and locked in latching grooves 16, spang jars (not shown) are then activated to jar up on OD fish neck 90 of the blanking plug assembly 10. It should be appreciated that lock sleeve 40 and latch sleeve 50 are pinned by shear pin 135 and are maintained in their lowermost position within annulus 25 by spring detent 130 and do not ride up on mandrel 24 of plug 20 as spang jars are jarring upward on OD fish neck 90. If these sleeves were not held in position, it is possible that movement between mandrel 24 and latch sleeve 50 could cause lock sleeve 40 and latch sleeve 50 to move upward. This upward movement would unlock dogs 120. Thus, upon jarring upward, detent member 126 prevents latch member 50 and thus lock sleeve 40 from riding up with mandrel 24.

The jarring up on plug 20 is a test for determining whether dogs 120 are in locking engagement within latching grooves 16. There is the possibility that the operator did not jar down hard enough to shear the pins 135 and set the dogs 120. If dogs 120 are not properly latched, then there is nothing to jar against and upon jarring up, the blanking plug assembly 10 will move upwardly within bore 12 of outer tubular member 14. However, if blanking plug assembly 10 is properly latched and locked into place within outer tubular member 14, dogs 120 will hold blanking plug assembly 10 in place during jarring up and thus the operator has a positive indication that blanking plug assembly 10 is locked into position.

As it is jarred upwardly, plug 20 moves upwardly with respect to landing sleeve 30 and sealing assembly 60 will engage the lower terminal end 105 of landing sleeve 30 thus preventing any further upward movement of sealing assembly 60 and seal support ring 48. Increased jarring upward shears pins 52 thus allowing the continued upward movement of plug 20 relative to sealing assembly 60.

Figure 11A:
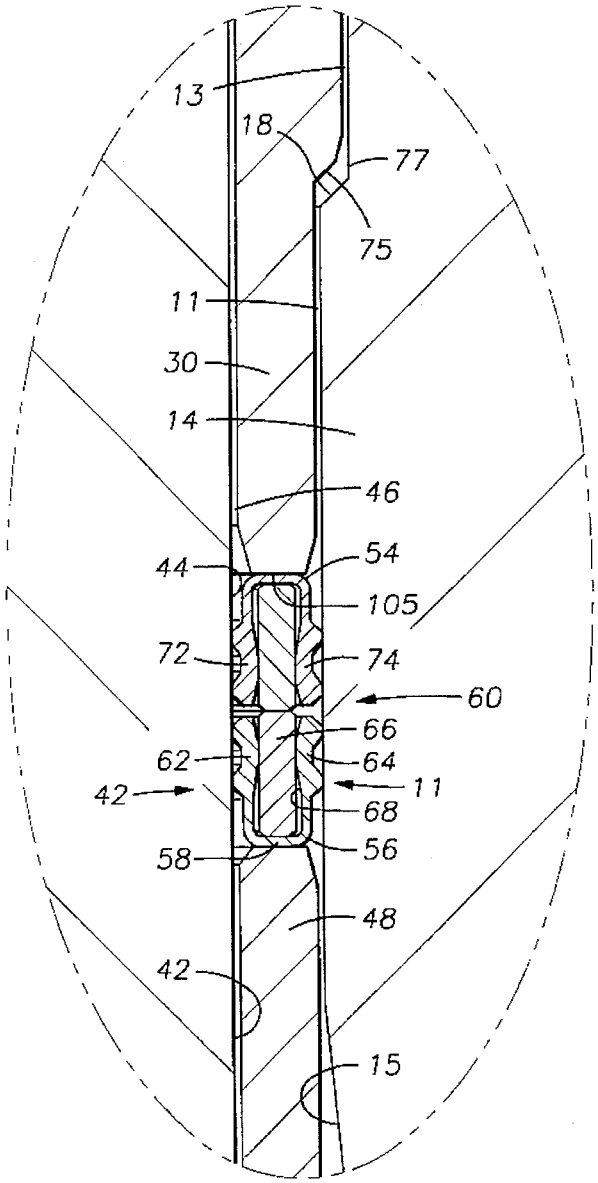
FIG. 11A is an enlarged detailed view of the sealing assembly as shown in FIG. 11 in the seal set position.

Referring now to FIGS. 11 and 11A, the continued jarring upward of plug 20 drives reduced diameter portion 26 through the inside diameter of sealing assembly 60. The sealing assembly 60 is now stationary as plug 20 moves upwardly. As plug 20 continues its upward movement, medial conically tapered portion 44 with its 2° inward taper passes through the inside diameter of sealing assembly 60 causing sealing assembly 60 to expand as the larger diameter of plug 20 is driven through. As sealing assembly 60 is cammed outwardly by tapered surface 44, outside legs 64, 74 sealingly engage seal bore 11. As plug 20 reaches its uppermost position, lower cylindrical portion 42 is driven through the inside diameter of sealing assembly 60 thereby radially energizing sealing assembly 60 between plug 20 and outer tubular member 14.

Plug 20 is shown in its uppermost position in FIG. 11. Plug 20 has engaged downwardly facing annular shoulder 106 on landing sleeve 30 and latching grooves 84, 86 have become aligned with latch segments 150. Garter spring 160 then contracts latch segments 150 causing latch segments 150 to shift radially inward with T-head 170 sliding within slot 172. In their innermost position, latch segmeats 150 are received within latch grooves 84, 86 in mandrel 24 to lock plug 20 in its uppermost position within landing sleeve 30. The operator will continue to jar up on plug 20 until there is metal-to-metal contact thereby providing a indication that latch segments 150 have been received into latch grooves 84, 86 and mandrel 20 is locked into its upper position.

A pressure test is performed after the plug 20 has been latched in its upper position and sealing assembly 60 has been radially energized. Pressure is applied down the bore 12 above blanking plug assembly 10 to determine whether the plug 20 is properly latched in its upper position and whether sealing assembly 60 has established a metal-to-metal seal with tubular member 14. If the blanking plug assembly 10 holds pressure, that is a positive indication that plug 20 is latched in place and sealing assembly 60 has established a metal-to-metal seal.

However, there are various reasons why plug 20 might not be latched into its position or why sealing assembly 60 has not sealingly engaged tubular member 14. For example, junk, sand, trash or other material may deposit on or around plug 20 preventing it from moving to its full upper position against downwardly facing shoulder 106 and therefore not aligned with latch segments 150. Such deleterious material might also prevent the sealing engagement of sealing assembly 60. There is a further possibility that plug 20 was not jarred hard enough by the spang jars to move plug 20 to its upper aligned position.

Should the pressure test indicate a leakage past plug 20, that is a negative indication that either plug 20 is not properly latched into its upper position or that sealing assembly 60 has failed to establish a seal. If latch segments 150 are not properly latched into grooves 84, 86, the pressure on top of the blanking plug assembly 10 during the pressure test will pump plug 20 back down through bore 102 of landing sleeve 30 until upper shoulder 80 in slot 78 engages pin 110. In this lower position, sealing assembly 60 is no longer set.

Upon failing the pressure test, the operator can jar up again in an attempt to engage latch segments 150 in grooves 84, 86 and obtain a metal-to-metal seal. If, upon a second pressure test the seals still leak, then the blanking plug assembly 10 should be retrieved to determine what went wrong.

The method and apparatus of the present invention provide definitive indications at each of the different positions of blanking plug assembly 10 within outer tubular member 14. Upon jarring up on plug 20, there is a definitive indication whether dogs 120 are in position in latching groove 16 and are locked in place since if they were not locked in place, jarring up would pull the blanking plug assembly 10 out of bore 12. The pressure test also provides a definitive indication whether plug 20 is latched in its upper position and whether sealing assembly 60 has established metal-to-metal sealing engagement with the seal bore 11 of tubular member 14. If there is no leakage, the operator knows that the blanking plug assembly 10 is in position, locked in place, and in sealing engagement. If there is leakage, either the plug 20 is not locked in place and/or the sealing assembly 60 has not established a seal. In the present invention, there is no possibility of inserting blanking plug assembly 10 into bore 12 and having it only partially latched or sealed and the operator not knowing it. With the definitive indications of the present invention, the operator is assured that blanking plug assembly 10 will not blow out of tubular member 14.

Once the sealing assembly 60 is set, the running tool 180 is released by jarring down and shearing shear pins 192. Upon shearing pins 192, the body 182 moves downwardly on actuator sleeve 190 thereby camming dog fingers 200 out of engagement with OD fish neck 90.

While a preferred embodiment of the invention has been shown and described, modifications thereof can be made by one skilled in the art without departing from the spirit of the invention.

We claim:

1. A method of plugging the bore of a tubular member comprising the steps of:

inserting a blanking plug assembly into the bore of the tubular member;

passing a sealing assembly on the blanking plug assembly into a seal bore in the bore of the tubular member without establishing a sealing engagement with the seal bore;

supporting the blanking plug assembly on a support shoulder on the tubular member;

jarring down on a first member of the blanking plug assembly to shift a plurality of dog members on the blanking plug assembly into latch grooves in the tubular member;

lifting the blanking plug assembly off of the support shoulder;

latching the dog members into the latch grooves;

locking the dog members in the latch grooves;

jarring up on a mandrel on the blanking plug assembly to move the mandrel to an upper position;

energizing the sealing assembly into sealing engagement with the seal bore; and latching the mandrel in the upper position.

2. The method of claim 1 further including during the jarring down step, the step of moving latch members into position and prior to latching the mandrel, the steps of aligning recesses in the mandrel with the latch members and shifting the latch members into the recesses.

3. The method of claim 2 further including the steps of maintaining the latch members in position.

4. The method of claim 1 further including the step of releasably connecting a running tool to the mandrel for inserting the blanking plug assembly into the tubular member.

5. The method of claim 1 further including the step of releasably connecting a pulling tool to the first member for removing the blanking plug assembly from the bore of the tubular member.

6. The method of claim 1 wherein the energizing step further includes the steps of:

preventing the movement of the sealing assembly on the blanking plug assembly; and forcing an increasing taper on the blanking plug assembly through the sealing assembly to radially energize the sealing assembly between blanking plug assembly member and the tubular member.

7. The method of claim 1 further including the steps of pressuring down on the blanking plug assembly whereby if there is no leakage, there is a positive indication of a latching and sealing engagement and if there is leakage, there is a negative indication of a latching or sealing engagement.

8. A blank plug assembly actuated by jars for closing and sealing the flowbore of a tubular member, comprising:

a first member having a bore and being adapted for support within the tubular member;

a mandrel reciprocably received in said bore, said mandrel having first and second positions with respect to first member;

a latch member disposed on said first member;

a seal mounted on said mandrel;

said seal being unenergized in said first position and said seal being energized and said mandrel engaging said latch member in said second position;

said first member including a plurality of dog members movably mounted thereon for engaging the tubular member;

said mandrel forming an annulus with said first member, a second member extending out of one end of said bore of said first member and into said annulus adapted for engagement with the jars for actuating said dog members and said latch member being disposed in said annulus.

9. A blanking plug assembly for a tubular member, comprising:

a first member having a bore and being adapted for support within the tubular member;

a mandrel reciprocably received in said bore, said mandrel having first and second positions with respect to said first member;

a latch member disposed on said first member;

a seal mounted on said mandrel;

said seal being unenergized in said first position and said seal being energized and said mandrel engaging said latch member in said second position;

said first member including a plurality of dog members movably mounted thereon for engaging the tubular member;

a second member for actuating said dog members; p1 a support shoulder on said first member adapted for engagement with the landing shoulder; and said dog members having a tapered surface for camming with the latch grooves to raise the support shoulder off the landing shoulder.

10. A blanking plug assembly for a tubular member, comprising:

a first member having a bore and being adapted for support within the tubular member;

a mandrel reciprocably received in said bore, said mandrel having first and second positions with respect to said first member;

a latch member disposed on said first member;

a seal mounted on said mandrel;

said seal being unenergized in said first position and said seal being energized and said mandrel engaging said latch member in said second position;

said mandrel including a tapered portion with said seal mounted at said tapered portion in said first position and said mandrel moving with respect to said seal to said second position whereby said tapered portion radially energizes said seal.

* * * * *